US005846053A

United States Patent [19]

Hagihara

[11] Patent Number: 5,846,053

[45] Date of Patent: Dec. 8, 1998

[54] BLADES FOR PADDLES AND OARS

[76] Inventor: Takeshi Hagihara, 2-288, Onji Nakamachi, Yao-shi, Osaka, Japan

[21] Appl. No.: 919,167

[22] Filed: Aug. 28, 1997

[51] Int. Cl.[6] ..... B63H 16/06

[52] U.S. Cl. ..... 416/74

[58] Field of Search ..... 416/74

[56] References Cited

U.S. PATENT DOCUMENTS 923,945 6/1909 Chaussinand .

1,786,451 12/1930 Ribard .

*Primary Examiner*—John T. Kwon

*Attorney, Agent, or Firm*—Wenderoth, Lind & Ponack, L.L.P.

[57] ABSTRACT

A blade for a paddle or an oar having a shaft and a paddling surface provided at a foremost end of the shaft, for enhancing paddling efficiency. The blade includes locking means provided on the paddling surface for locking water when the paddle or oar is operated with the shaft, the locking means comprising a plurality of circular, elliptical or polygonal hollows formed and arranged on the paddling surface in rows or in a grid pattern, each of the hollows having an area of 1/100 to 1/50 of an area of the paddling surface.

15 Claims, 7 Drawing Sheets

BLADES FOR PADDLES AND OARS

BACKGROUND OF THE INVENTION

1. Field of the Invention

This invention relates to blades for paddles or oars of boats and canoes.

2. Description of the Prior Art

In general, a paddle or an oar of a boat and a canoe comprises a round pipe-like shaft having a handle at a top end thereof; and a flat blade provided at a bottom end portion of the shaft.

Paddles or oars designed especially for boat races and canoe races are being required to enhance paddling efficiency while attempting of weight reduction or reduce operating forces at the strokes of the paddle or oar, and improvements in the blade for the paddle or oar have been proposed, as disclosed by U.S. Pat. No. 1,786,451 and GB 2,201,929 A, for example.

U.S. Pat. No. 1,786,451 discloses a paddling surface (a blade) for a paddle or an oar in which a number of tapered holes penetrating from the front side to the rear side of the blade are bored nearly at the center part, so that a water resistance in the blade is attempted to be diminished in the paddling. GB 2,201,929 A discloses a paddling surface (a blade) for a paddle or an oar in which a number of fine indentations of 3.5 mm square and 0.15–0.25 mm deep are provided covering the entire surface coated with resin, except the margin around the blade, so that the contact area of the blade with water can be enlarged.

However, the paddle blade having the tapered holes penetrating the blade disclosed in the U.S. Pat. No. 1,786,451 has a disadvantage that water goes through the penetrating holes, so that effective utilization of a paddling surface is reduced considerably to that extent, though the pressure acting on the blade in the paddling is diminished by the extent of the areas of the penetrating holes.

In addition to this, part of the blade forming a number of penetrating holes thereon decreases in strength. For compensation for the decrease in strength, the blade is required to increase in thickness, resulting in increase in weight of the blade.

On the other hand, the paddling blade disclosed in GB 2,201,929 A has a disadvantage that the ratio of the individual indentation to the paddling surface is too fine to produce a sufficient effect on the paddling efficiency from the indentations, though water does not go through the blade.

SUMMARY OF THE INVENTION

Accordingly, the inventor has devoted himself to a study to solve the above-mentioned problems and has realized the blade for the paddle or oar capable of enhancing the paddling efficiency.

According to the invention, a blade for a paddle or an oar having a shaft and a paddling surface provided at a foremost end of the shaft comprises locking means provided on the paddling surface for locking water when the paddle or oar is operated with the shaft, the locking means comprising a plurality of circular, elliptical or polygonal hollows formed and arranged on the paddling surface in rows or in a grid pattern, each hollow having an area of 1/100 to 1/50 of an area of the paddling surface.

According to the invention, it is preferable that each of the hollows formed on the paddling surface has a depth of 1/10–3/10 of a diameter, a major axis or a diagonal line of the circular, elliptical or polygonal hollow.

Further, according to the invention, it is desirable that the each of the hollows formed on the paddling surface has a bottom whose lowermost end part deviates from the center of the circular, elliptical or polygon hollow toward the foremost end of the blade, to allow for warp or bending of the paddle or oar in the rowing or paddling, and it is also advantageous that the paddling surface is so formed as to have a curved surface whose center of curvature is located at a place on the fore side in a paddling direction for the paddle or oar to be operated with the shaft, to allow for warp of the paddle or oar in the rowing or paddling.

Also, according to the invention, a blade for a paddle or an oar having a shaft and a paddling surface provided at a foremost end of the shaft may comprise locking means comprising a line of or two or more lines of ribs formed on the paddling surface for locking water when the paddle or oar is operated with the shaft.

BRIEF DESCRIPTION OF THE DRAWINGS

The invention will now be described with reference to the accompanying drawings wherein.

DETAILED DESCRIPTION OF THE PREFERRED EMBODIMENT

Referring now to the accompanying drawing figures, an example of the preferred embodiment of a blade for a paddle or an oar of the invention is described below. It is to be understood, however, that the scope of the invention is by no means limited to the illustrated embodiments.

Figure 1:
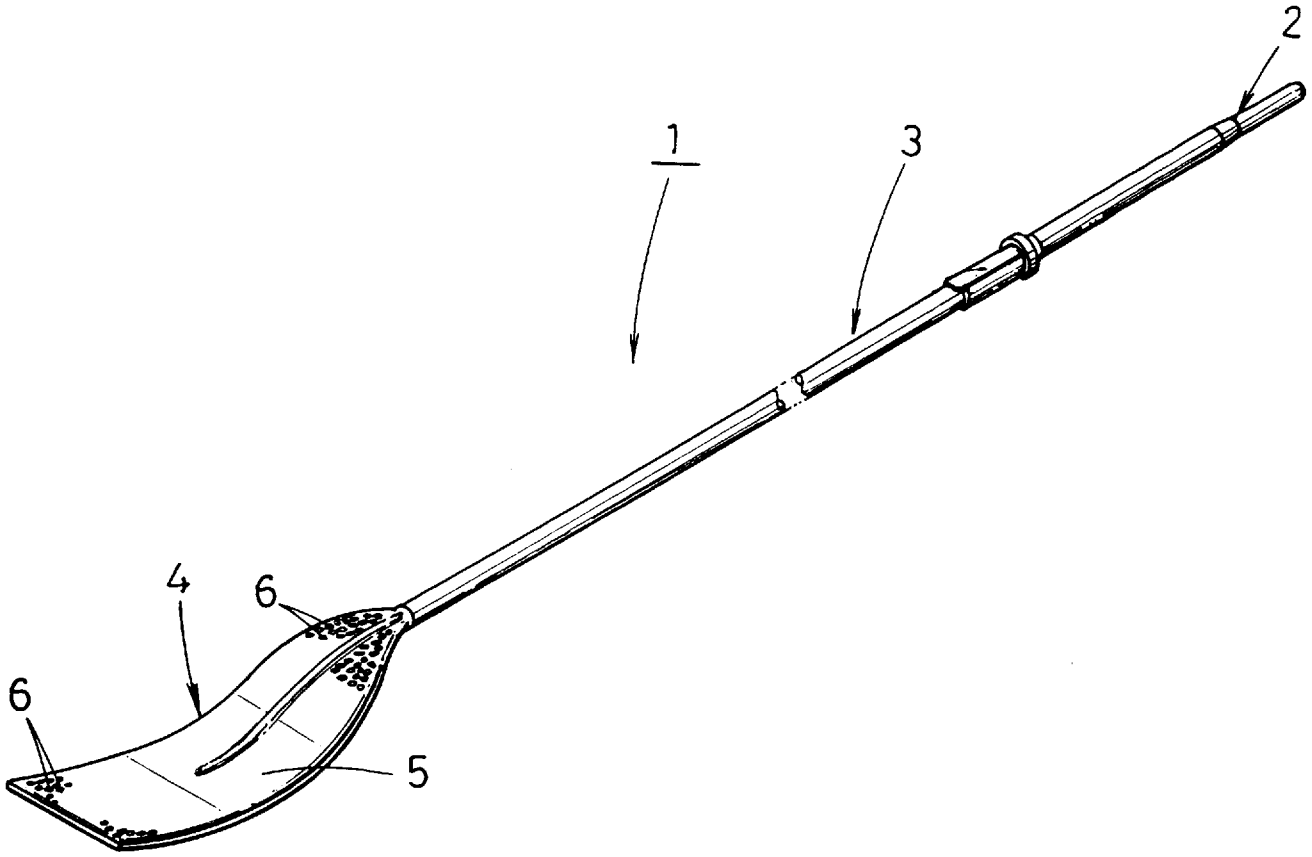
FIG. 1 is an overall perspective view of an oar of the invention.

FIG. 1 is a perspective view of an entire oar, and the reference numeral 1 in the drawing figures denotes the entire oar.

The oar 1 comprises a bar-like shaft 3 having a handle 2 at its top end and a plate-like blade 4 provided at a bottom end of the shaft. The shaft 3 is made of what is called FRP using carbon fibers and glass fibers as reinforcement and is formed into a hollow body.

Figure 2:
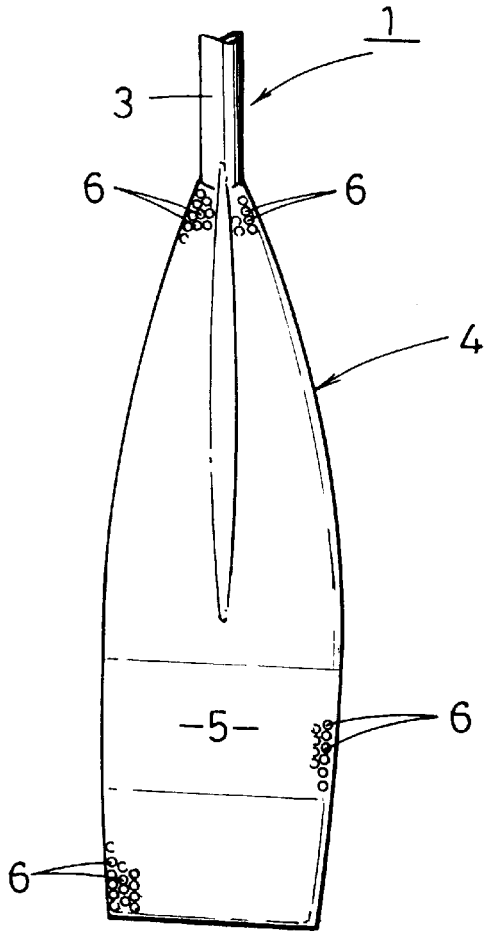
FIG. 2 is a front view of a blade of the oar of the invention.
Figure 3:
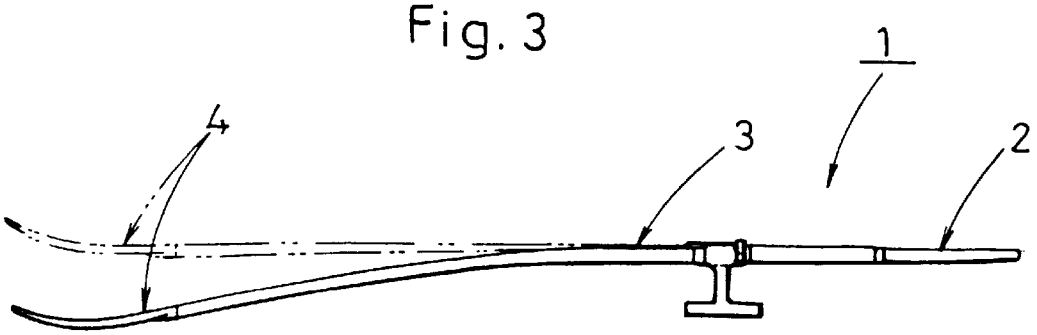
FIG. 3 is a side view of the oar of the invention as warped or bent at the stroke.

The plate-like blade 4 at the bottom end of the shaft 3 is so curved as to have a curved paddling surface 5 whose center of curvature is located at a place on the fore side in a paddling direction of the oar. On the curved paddling surface 5 are formed a plurality of hollows 6 (locking means), as shown in FIG. 2. The plate-like blade 4 is curved to have a curvature, in order to row with effective strokes when the shaft 3 is bent under water resistance to change from an original straight-line state shown by an imaginary line into a bending state shown by a solid line in FIG. 3.

Figure 4:
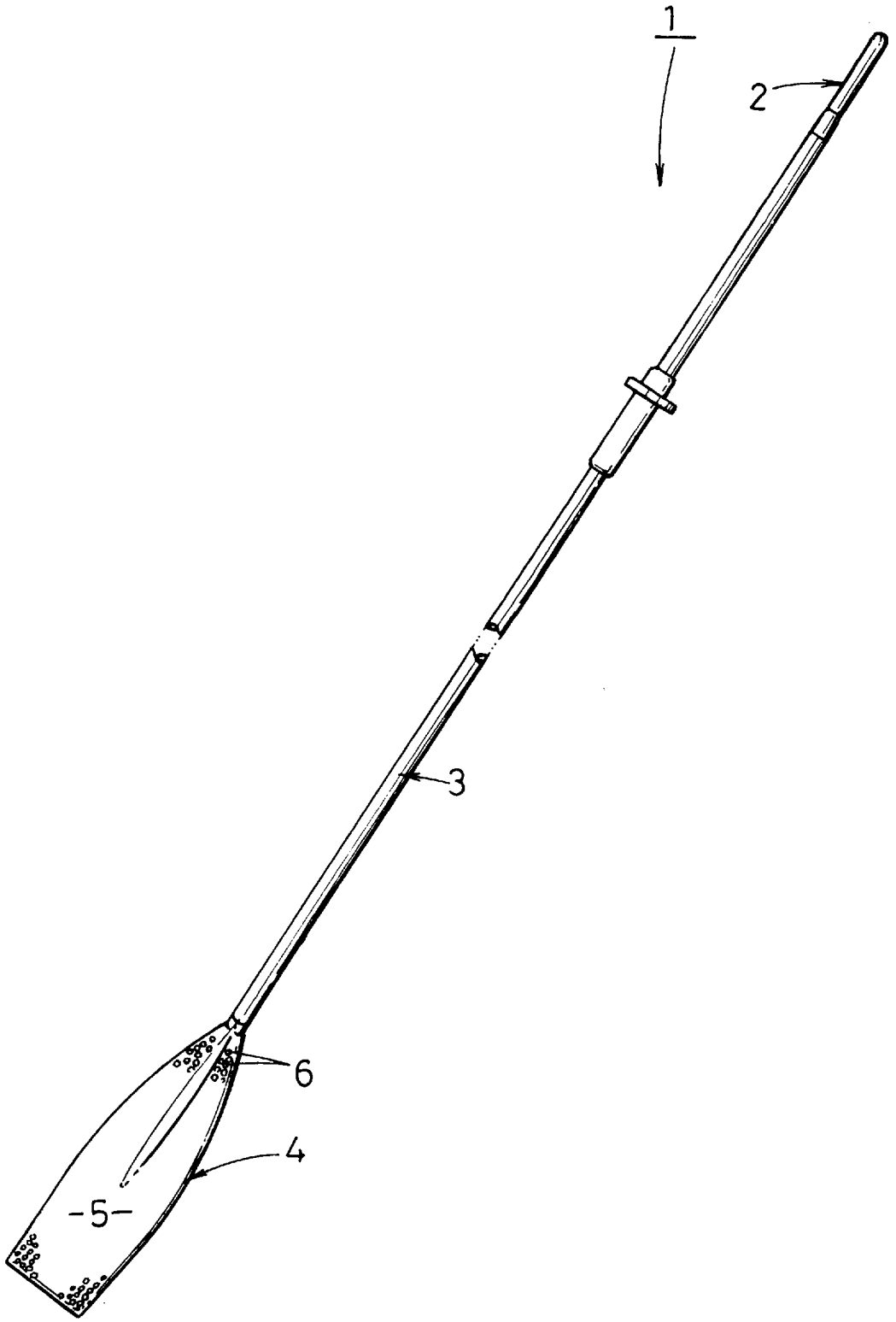
FIG. 4 is an overall perspective view of the oar having a flat blade of the invention.

If the shaft 3 is hard to bend, for example, the blade 4 may of course be formed into a straight plate-like shape, as shown in FIG. 4.

Figure 5:
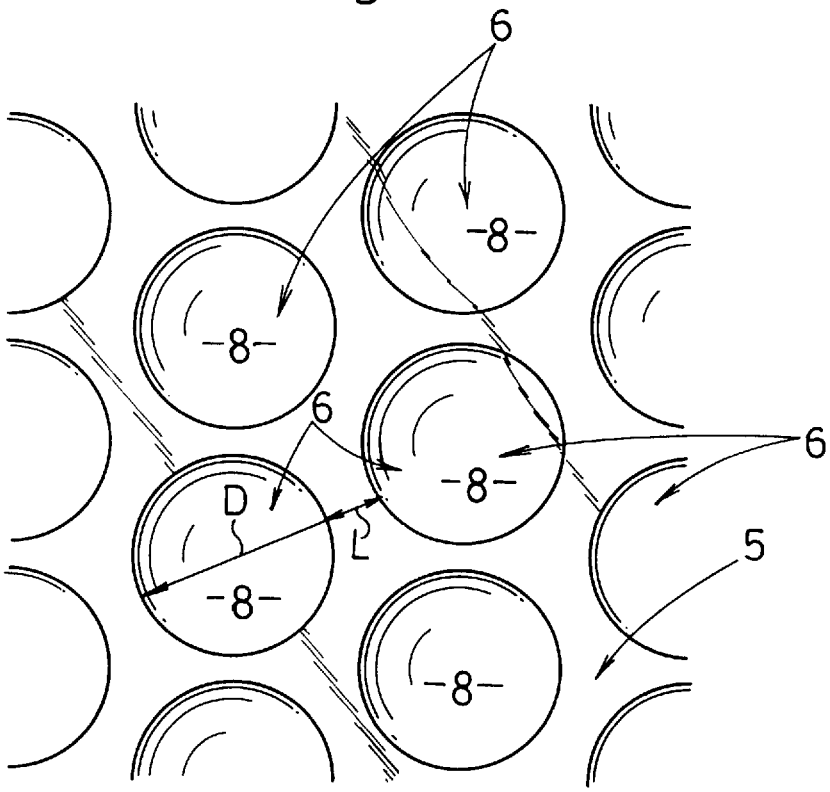
FIG. 5 is an enlarged view of a part of hollows on the oar of the invention.
Figure 6:
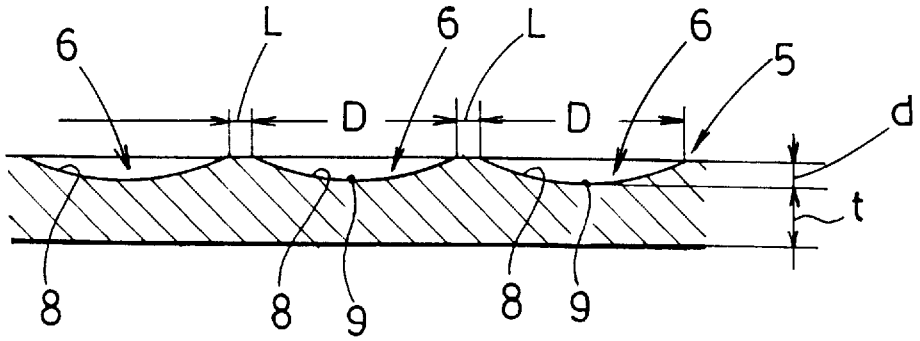
FIG. 6 is an enlarged sectional view of the part of hollows on the oar of the invention.

The hollows 6 on the blade 4 shown in FIGS. 5 and 6 are composed of circular indentations having gently dimpled, spherical bottom portions 7, like what is called "dimples" on a golf ball and are arranged uniformly on the paddling surface 5 of the front surface of the blade 4.

The details of the individual hollows 6 are described below. Each hollow 6 is formed in circle having an area of 1/80 of the whole area of the paddling surface 5 (a projected area of the blade 4). The depth d of the each hollow 6 at the spherical bottom portion 8 is set to be 1/5 of the diameter of the circular hollow 6. Also, the neighboring hollows 6, 6 are spaced apart from each other at an interval L of 1 mm or more.

When this formed hollows 6 are practically applied to the blade 4 of a standard oar 1 having a projected area of about 960 $cm^2$, the area of the each hollow 6 comes to be 12 $cm^2$ and thus the diameter D and the depth d of the each hollow 6 come to be 3.9 cm (nearly 4.0 cm) and about 0.8 cm, respectively.

Experiments proved that the most effective ratio of the area of the hollow 6 to the whole area of the paddling surface 5 is in the range of 1/00 to 1/50 and the most effective ratio of the depth d of the hollow 6 to the diameter D of the same is in the range of 1/10 to 3/10.

In the case where the ratio of the area of the each hollow 6 to the whole area of the paddling surface 5 is below 1/100, the hollow 6 comes to be so small that water can slide over the paddling surface 5 without being caught by the hollows effectively, so that the catching effect of the hollows is reduced significantly and resultantly such a blade will be substantially the same as a smooth blade.

On the other hand, in the case where the ratio of the area of the each hollow 6 to the whole area of the paddling surface 5 is over 1/50, as the diameter of the hollow 6 increases, the depth of the hollow 6 will increase. Thus, attempting to keep the minimum standard thickness t (about 5 mm) between the lowermost part 9 of the bottom 8 of the hollow 6 and the back surface of the blade 4 will require increased thickness and weight of the blade 4.

Also, the reason the ratio of the depth d of the hollow 6 to the diameter of the same is in the range of 1/10 to 3/10 is as follows. If the hollow 6 is made so shallow that the depth d is less than 1/10 of the diameter, the paddling surface 5 will be nearly flat or smooth so that water can slide over the paddling surface 5 without being caught by the hollows effectively, and accordingly the catching effect of the hollows is reduced significantly. On the other hand, if the hollow 6 is made so deep that the depth d is more than 3/10 of the diameter, it will be harder to drain water from the blade when the blade comes out of water, and accordingly operability of the oar in strokes will lower. In addition to this, combined with an increasing area of the hollow 6, the thickness and thus the weight of the blade 4 will be increased.

Figure 7:
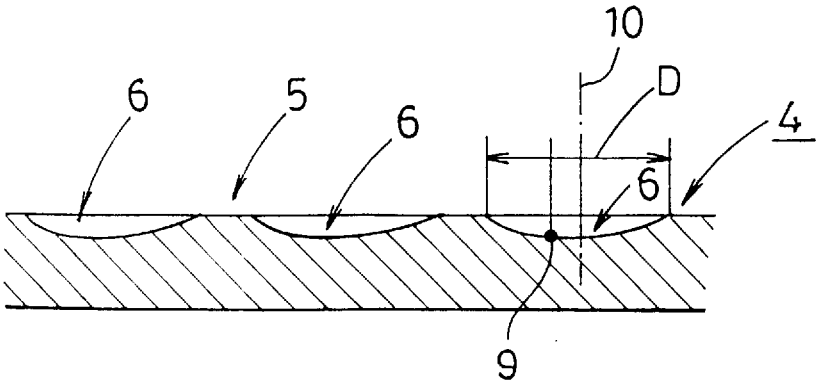
FIG. 7 is an enlarged sectional view of a part of modified hollows on the oar of the invention.

In the above-mentioned embodiment, the blade 4 is curved to allow for warp or bending resulting from water resistance, as mentioned above. Preferably, the lowermost end part 9 of the bottom 8 of each of the hollows 6 is located at a position deviating from the center position 10 toward the foremost end of the blade 4, as shown in FIG. 7, for allowing for the expected warp or bending.

Further, in the above-described embodiment, the neighboring hollows 6 are spaced apart from each other at an interval L of 1 mm or more, for convenience in molding or manufacturing the blade 4 using light metals, such as titanium or titanium alloys, as manufacturing materials for the blade 4. Of course, the hollows 6 may be formed and arranged on the blade in the vicinity of or in abutment with each other.

Figure 8:
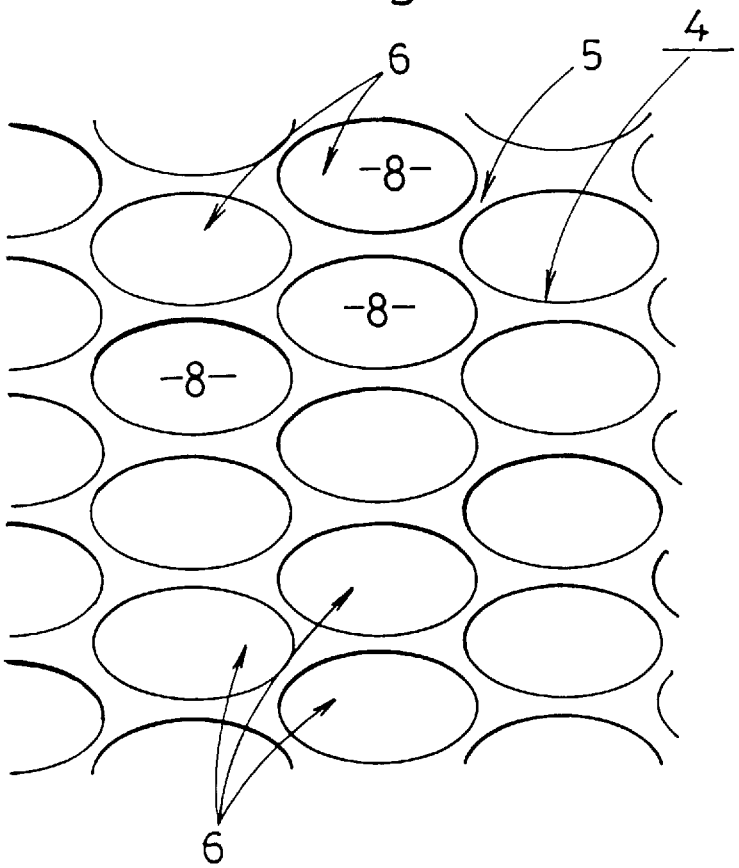
FIG. 8 is an enlarged view of a part of the hollows varied in shape on the oar of the invention.
Figure 9:
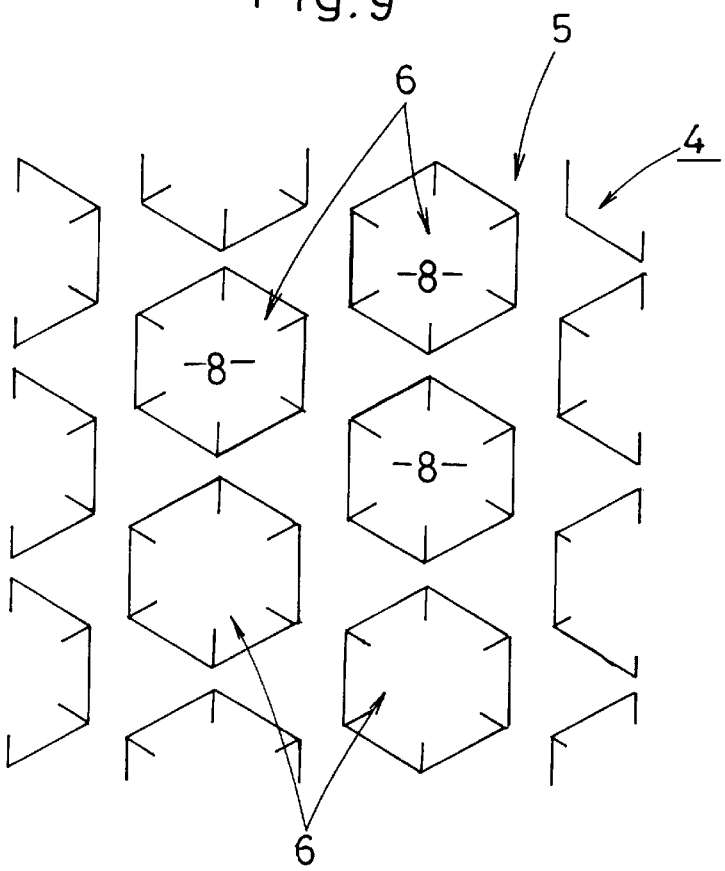
FIG. 9 is an enlarged view of a part of the hollows further varied in shape on the oar of the invention.
Figure 10:
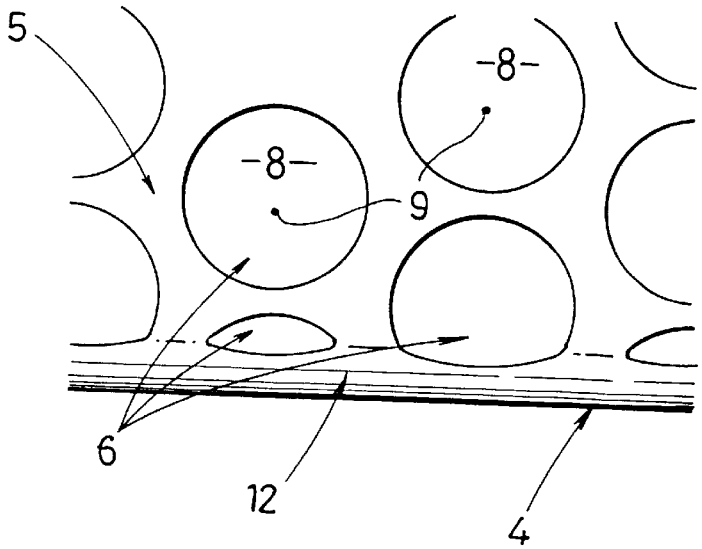
FIG. 10 is an enlarged view of a part of the hollows varied in position on the oar of the invention.

Also, the hollows 6 on the paddling surface 5 may be formed into any other shapes than a circle, e.g. an ellipse as shown in FIG. 8, a hexagon as shown in FIG. 9, or other polygons or ovals not shown. The hollows 6 may of course be arrayed in such a manner that part of the hollows 6 extends as far as the side edges 12 of the blade 4, as shown in FIG. 10.

Figure 11:
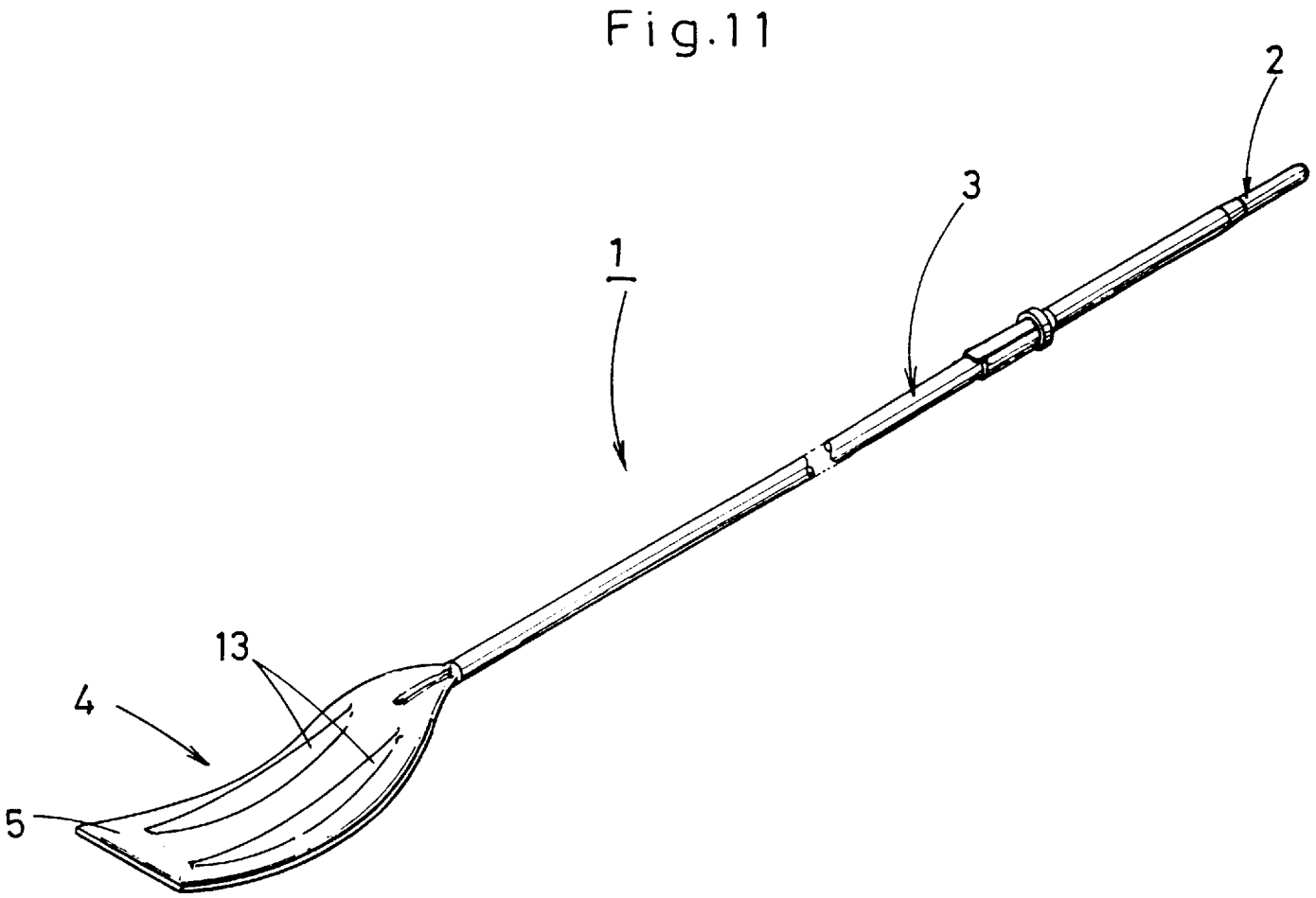
FIG. 11 is a perspective view of the oar, showing a variant of the locking means of the invention.

In addition, the locking means in the above-described embodiments may be formed by ribs 13 formed on the paddling surface 5, as shown in FIG. 11, other than by the hollows 6 formed into a circle, an ellipse, a hexagon, or any other polygons or ovals. In this modification, the ribs 13 serves to reinforce the blade 4 and thus can provide an additional advantage of reducing the thickness of the entire blade 4.

It is needless to say that any number of ribs 13 or one or more ribs 13 may be provided for the blade in FIG. 11.

What is claimed is:

1. A blade to be employed on a foremost end of a shaft of a paddle or oar, said blade comprising:

a paddling surface to be forced through water during use of the paddle or oar;

means in said paddling surface for locking water during use, said means comprising a plurality of recesses formed in said paddling surface; and each said recess extending only partly through the thickness of said blade, and each said recess having an area equal to 1/100 to 1/50 of the area of said paddling surface.

2. A blade as claimed in claim 1, wherein said plurality of recesses are arranged in rows in said paddling surface.

3. A blade as claimed in claim 1, wherein said plurality of recesses are arranged in a pattern in said paddling surface.

4. A blade as claimed in claim 3, wherein said pattern is a grid pattern.

5. A blade as claimed in claim 1, wherein at least one said recess is circular.

6. A blade as claimed in claim 5, wherein all of said recesses are circular.

7. A blade as claimed in claim 5, wherein said at least one circular recess has a depth equal to 1/10 to 3/10 of the diameter thereof.

8. A blade as claimed in claim 9, wherein at least one said recess is elliptical.

9. A blade as claimed in claim 8, wherein all of said recesses are elliptical.

10. A blade as claimed in claim 8, wherein said at least one elliptical recess has a depth equal to 1/10 to 3/10 of a major axis thereof.

11. A blade as claimed in claim 1, wherein at least one said recess is polygonal.

12. A blade as claimed in claim 11, wherein all of said recesses are polygonal.

13. A blade as claimed in claim 11, wherein said at least one polygonal recess has a depth equal to 1/10 to 3/10 of a diagonal thereof.

14. A blade as claimed in claim 1, wherein each said recess has an innermost portion that is offset from a center of said recess.

15. A blade as claimed in claim 1, wherein said paddling surface is curved about a center of curvature located outwardly of said paddling surface.

* * * * *